US007221097B2

(12) United States Patent
Kweon

(10) Patent No.: US 7,221,097 B2
(45) **Date of Patent: *May 22, 2007**

(54) PLASMA DISPLAY PANEL WITH CONTROLLED DISCHARGE DRIVING VOLTAGE

(75) Inventor: Tae-Joung Kweon, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 0 days.

This patent is subject to a terminal disclaimer.

(21) Appl. No.: 11/325,601

(22) Filed: Jan. 5, 2006

(65) Prior Publication Data

US 2006/0132040 A1 Jun. 22, 2006

Related U.S. Application Data

(63) Continuation-in-part of application No. 11/105,480, filed on Apr. 14, 2005, now Pat. No. 7,015,643.

(30) Foreign Application Priority Data

May 7, 2004 (KR) ..... 10-2004-0032202

(51) Int. Cl.
*H01J 17/49* (2006.01)

(52) U.S. Cl. ..... 313/583; 313/582; 313/586; 313/584; 315/169.4

(58) Field of Classification Search ..... 313/583, 313/586, 582, 584; 315/169.4
See application file for complete search history.

(56) References Cited

U.S. PATENT DOCUMENTS 5,004,950 A 4/1991 Lee (Continued)

FOREIGN PATENT DOCUMENTS

JP 2845183 10/1998
JP 2917279 4/1999

(Continued)

OTHER PUBLICATIONS

"*Final Draft International Standard*", Project No. 47C/61988-1/Ed. 1; Plasma Display Panels—Part 1: Terminology and letter symbols, published by International Electrotechnical Commission, IEC. in 2003, and Appendix A—Description of Technology, Annex B—Relationship Between Voltage Terms And Discharge Characteristics; Annex C—Gaps and Annex D—Manufacturing.

*Primary Examiner*—Mariceli Santiago
*Assistant Examiner*—Peter Macchiarolo
(74) *Attorney, Agent, or Firm*—Robert E. Bushnell, Esq.

(57) ABSTRACT

A plasma display panel (PDP) includes a front panel, a rear panel disposed parallel to the front panel, side dielectric layers formed of a dielectric material and disposed between the front panel and the rear panel so as to define a plurality of discharge cells, front discharge electrodes disposed inside the side dielectric layers, and spaced from side surfaces of the discharge cells toward interiors of the side dielectric layers by an electrode-burying depth, rear discharge electrodes disposed inside the side dielectric layers and at a rear side of the first discharge electrodes, and spaced apart from the side surfaces of the discharge cells toward the interiors of the side dielectric layers by the electrode-burying depth, a plurality of phosphor layers corresponding to the discharge cells for emitting visible rays, the phosphor layers having different dielectric constants, and a discharge gas deposited in the discharge cells. An electrode-burying depth corresponding to discharge cells differs according to a magnitude of a dielectric constant of phosphor layers corresponding to the discharge cells.

17 Claims, 8 Drawing Sheets

U.S. PATENT DOCUMENTS

| | | | | |
|---|---|---|---|---|
| 5,175,473 | A | 12/1992 | Kim | |
| 5,371,437 | A | 12/1994 | Amano | |
| 5,541,618 | A | 7/1996 | Shinoda | |
| 5,661,500 | A | 8/1997 | Shinoda et al. | |
| 5,663,741 | A | 9/1997 | Kanazawa | |
| 5,674,553 | A | 10/1997 | Shinoda et al. | |
| 5,724,054 | A | 3/1998 | Shinoda | |
| 5,744,909 | A | 4/1998 | Amano | |
| 5,786,794 | A | 7/1998 | Kishi et al. | |
| 5,952,782 | A | 9/1999 | Nanto | |
| RE37,444 | E | 11/2001 | Kanazawa | |
| 6,512,499 | B1 | 1/2003 | Abe | |
| 6,541,914 | B1 * | 4/2003 | Ahn | 313/586 |
| 6,630,916 | B1 | 10/2003 | Shinoda | |
| 6,707,436 | B2 | 3/2004 | Setoguchi et al. | |
| 6,753,645 | B2 | 6/2004 | Haruki et al. | |
| 6,873,105 | B2 | 3/2005 | Akiba | |
| 6,903,711 | B2 | 6/2005 | Akiba | |
| 2002/0047521 | A1 | 4/2002 | Kim et al. | |
| 2004/0245929 | A1 | 12/2004 | Sakamoto | |
| 2005/0093444 | A1 | 5/2005 | Woo et al. | |
| 2005/0116646 | A1 | 6/2005 | Yoo et al. | |
| 2006/0082306 | A1 * | 4/2006 | Song | 313/583 |
| 2006/0158113 | A1 * | 7/2006 | Hur et al. | 313/582 |
| 2006/0170630 | A1 * | 8/2006 | Hur et al. | 345/77 |

FOREIGN PATENT DOCUMENTS

| | | | | |
|---|---|---|---|---|
| JP | 2001-043804 | | | 2/2001 |
| JP | 2001-325888 | | | 11/2001 |
| JP | 2004039601 | A | * | 2/2004 |
| JP | 2005183037 | A | * | 7/2005 |
| KR | 2003069358 | A | * | 8/2003 |
| KR | 2005022705 | A | * | 3/2005 |
| KR | 2005040962 | A | * | 5/2005 |
| KR | 2005045045 | A | * | 5/2005 |

* cited by examiner

PLASMA DISPLAY PANEL WITH CONTROLLED DISCHARGE DRIVING VOLTAGE

CROSS-REFERENCE TO RELATED APPLICATIONS

This application is a Continuation-In-Part application of U.S. patent application Ser. No. 11/105,480 filed in the U.S. Patent & Trademark Office on 14 Apr. 2005 now U.S. No. 7,015,643, and assigned to the assignee of the present invention.

CLAIM OF PRIORITY

This application makes reference to, incorporates the same herein, and claims all benefits accruing under 35 U.S.C. §119 from an application for PLASMA DISPLAY PANEL earlier filed in the Korean Intellectual Property Office on May 7, 2004 and there, duly assigned Serial No. 10-2004-0032202.

BACKGROUND OF THE INVENTION

1. Technical Field

The present invention relates to a plasma display panel (PDP), and more particularly, to a PDP used as a flat display panel in which electrodes are arranged on the opposed surfaces of substrates, discharge gas is filled in a discharge space between the substrates, and an image is displayed using light emitted by ultraviolet rays which are generated in the discharge space with application of a predetermined voltage.

2. Related Art

In recent years, display apparatuses employing a plasma display panel as a flat display panel have been widely used. Such display apparatuses have excellent characteristics such as high image quality, ultra thin thickness, small weight, and wide viewing angle, in addition to a large-sized screen. In addition, the display apparatuses can be easily manufactured and easily increased in size. Therefore, such display apparatuses have attracted attention as a next generation of large-sized flat display apparatuses.

PDPs are classified into a direct current (DC) type PDP, an alternating current (AC) type PDP, and a hybrid type PDP depending on the applied discharge voltages, and into an opposing discharge type and a surface discharge type depending on the discharge structures.

The DC type PDP has a structure in which all electrodes are exposed to discharge spaces and electric charges move directly between the corresponding electrodes. Conversely, the AC type PDP has a structure in which at least one electrode is covered with a dielectric layer and the electric charges do not move directly between the corresponding electrodes. The discharge of the AC type PDP is performed by an electric field of wall charges.

Since the electric charges move directly between the corresponding electrodes in the DC type PDP, there is a problem in that the electrodes are seriously damaged. Accordingly, an AC type PDP having a three-electrode surface-discharge structure has been recently adopted.

An AC type three-electrode surface-discharge PDP is disclosed in U.S. Pat. No. 6,753,645 to Haruki et al., entitled PLASMA DISPLAY PANEL, issued on Jun. 22, 2004.

SUMMARY OF THE INVENTION

The present invention relates to a plasma display panel (PDP) in which aperture ratio and transmittance are greatly increased, the discharge area is significantly enlarged with significant enlargement of a discharge surface, and discharge is uniformly performed in the entire discharge area.

Furthermore, the present invention provides a PDP which can efficiently utilize space charges of plasma, improve light emission efficiency, and reduce permanent after-image phenomenon.

In addition, the present invention provides a PDP which can secure a large voltage margin by controlling a discharge driving voltage such that the discharge driving voltage is constant or similar in maximum amount in the discharge cells in which phosphor layers having different dielectric constants are formed.

According to an aspect of the present invention, there is provided a PDP including a front panel, a rear panel, side dielectric layers, front discharge electrodes, rear discharge electrodes, and phosphor layers. An electrode-burying depth corresponding to discharge cells differs according to magnitude of the dielectric constant of phosphor layers corresponding to the discharge cells. In this regard, an electrode-burying depth, corresponding to discharge cells in which phosphor layers having the lowest dielectric constant are formed, is smaller than an electrode-burying depth corresponding to discharge cells in which phosphor layers having a relatively high dielectric constant are formed.

In this case, the front panel and the rear panel are disposed parallel to each other and are spaced apart from each other. The side dielectric layers are formed of a dielectric substance and disposed between the front panel and the rear panel so as to define a plurality of discharge cells. The front discharge electrodes are disposed inside the side dielectric layers so as to surround the discharge cells, and are spaced from the side surfaces of the discharge cells toward the interiors of the side dielectric layers by an electrode-burying depth. The rear discharge electrodes are disposed inside the barrier ribs so as to surround the discharge cells, and are spaced from the side surface of the discharge cell toward the interiors of the side dielectric layers by an electrode-burying depth at the rear side of the first discharge electrodes. The phosphor layers having different dielectric constants are disposed inside the discharge cells, and receive ultraviolet rays and emit visible rays. Discharge gas fills the discharge cells.

According to another aspect of the present invention, there is provided a PDP including a front panel, a rear panel, side dielectric layers, front discharge electrodes, rear discharge electrodes, address electrodes, a dielectric layer, and phosphor layers. An electrode-burying depth corresponding to discharge cells differs according to a magnitude of the dielectric constant of phosphor layers corresponding to the discharge cells. In this regard, the electrode-burying depth, corresponding to the discharge cells in which the phosphor layers having the lowest dielectric constant are formed, is smaller than the electrode-burying depth corresponding to the discharge cells in which the phosphor layers having a relatively high dielectric constant are formed.

In this case, the front panel and the rear panel are disposed parallel to each other and are spaced from each other. The side dielectric layers are formed of a dielectric substance and are disposed between the front panel and the rear panel so as to define a plurality of discharge cells. The front discharge electrodes are disposed inside the side dielectric layers so as to surround the discharge cells, and are spaced from the side surfaces of the discharge cells toward the interiors of the side dielectric layers by the electrode-burying depth. The rear discharge electrodes are disposed inside the barrier ribs so as to surround the discharge cells, and are spaced from the side surfaces of the discharge cells toward the interiors of the side dielectric layers by the electrode-burying depth at the rear side of the first discharge electrodes. The address electrodes are disposed on the rear panel, and extend in a direction which intersects the front discharge electrodes and the rear discharge electrodes. The dielectric layer covers the address electrodes. The phosphor layers have different dielectric constants, are disposed at least on the dielectric layer inside the discharge cells, and receive ultraviolet rays and emit visible rays. Discharge gas fills the discharge cells.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
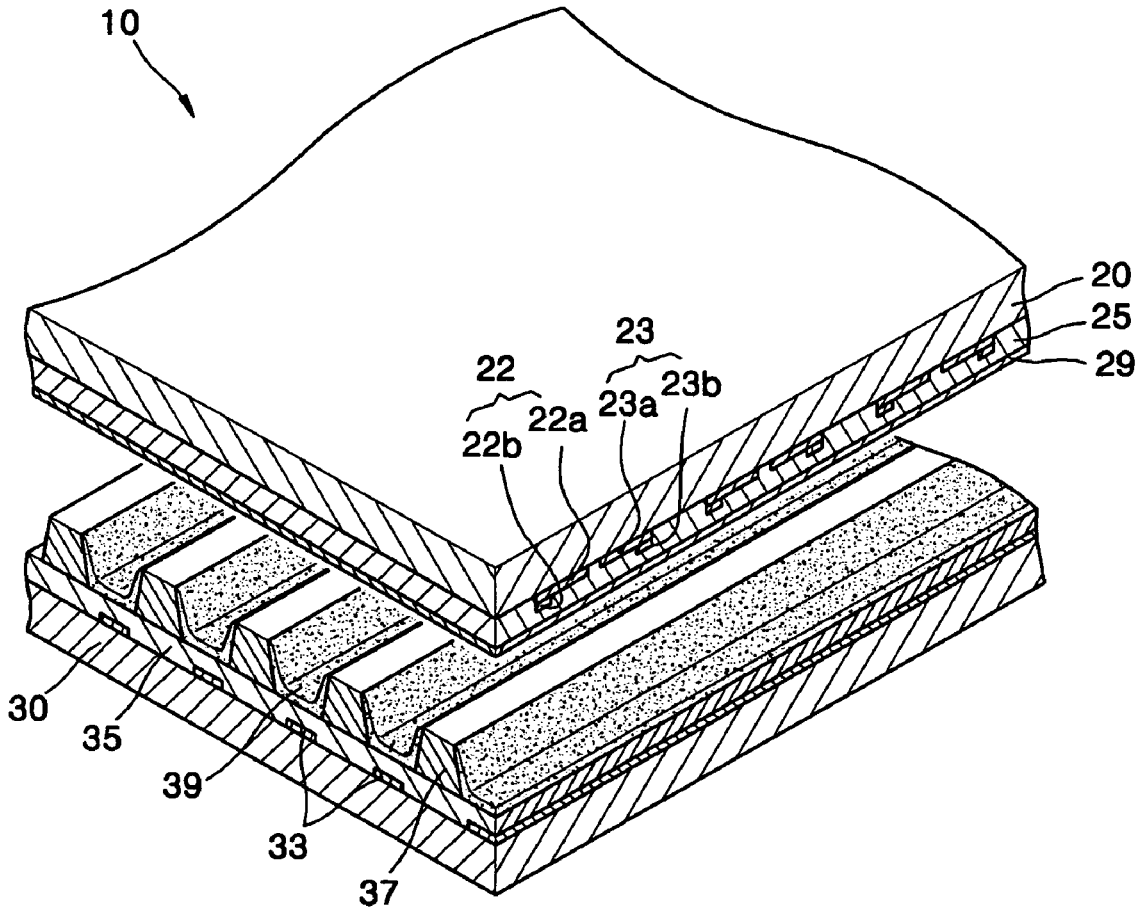
FIG. 1 is an exploded perspective view of an alternating current (AC) three-electrode surface-discharge plasma display panel (PDP)

FIG. 1 is an exploded perspective view of an alternating current (AC) three-electrode surface-discharge plasma display panel (PDP).

Referring to FIG. 1, an AC type three-electrode surface-discharge PDP 10 includes a front panel 20 and a rear panel 30.

The rear panel 30 is provided with address electrodes 33 generating address discharge, a rear dielectric layer 35 covering the address electrodes 33, barrier ribs 37 defining discharge cells, and phosphor layers 39 coated on both side surfaces of the barrier ribs 37 and portions of the rear panel 30 in which the barrier ribs 37 are not formed.

The front panel 20 is disposed to oppose the rear panel 30, and is provided with X and Y electrodes 22 and 23 generating sustain discharge, a front dielectric layer 25 covering the X and Y electrodes 22 and 23, and a protective layer 29. In this case, each X electrode 22 includes a transparent X electrode 22*a*, and a bus X electrode 22*b* which is disposed at a side of the transparent X electrode 22*a* and which compensates for voltage loss of the transparent X electrode 22*a*. Each Y electrode 23 includes a transparent Y electrode 23*a*, and a bus Y electrode 23*b* which is disposed at a side of the transparent Y electrode 23*a* and which compensates for voltage loss of the transparent Y electrode 23*a*.

However, in the PDP 10, the transparent X electrodes 22*a*, the bus X electrodes 22*b*, the transparent Y electrodes 23*a*, the bus Y electrodes 23*b*, the front dielectric layer 25, and the protective layer 29 exist on the portion of the front panel 20 through which visible rays emitted from the phosphor layers 39 in the discharge spaces are transmitted. The PDP 10 has a serious problem in that the transmittance of the visible rays decreases to about 60% due to such factors.

Furthermore, in the surface-discharge PDP 10, the discharge electrodes are formed on the upper side of the discharge space, that is, on the inner surface of the front panel 20 transmitting the visible rays. As a result, since the discharge occurs from the inner surface of the front panel 20 and diffuses into the discharge space, the surface-discharge PDP 10 has a basic problem in that the light emission efficiency decreases.

In addition, in the surface-discharge PDP 10, when it works for a long period of time, charged particles of the discharge gas cause an ion sputtering phenomenon in the fluorescent substance, whereby undesirable permanent after-images are generated.

Figure 2:
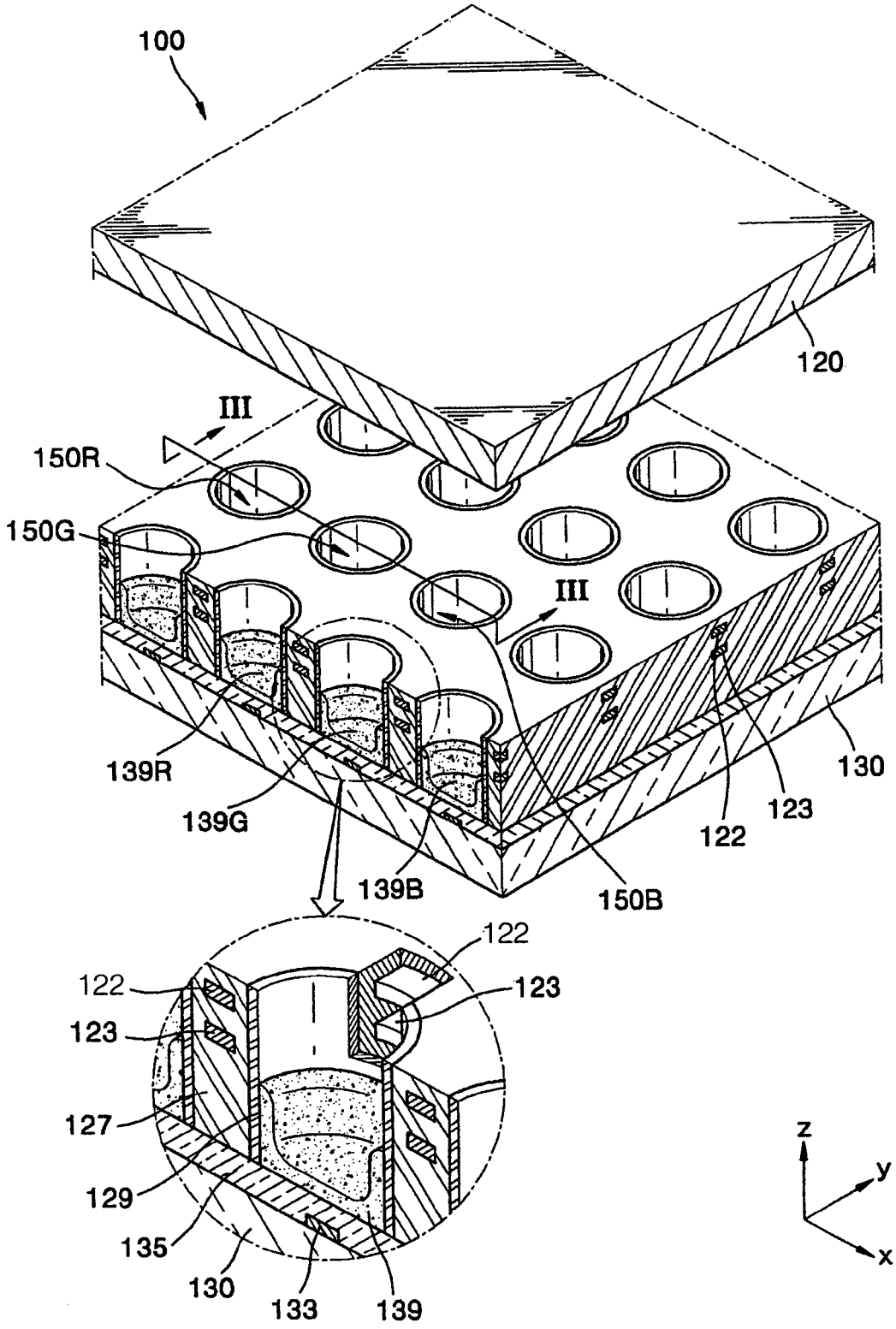
FIG. 2 is an exploded perspective view of a PDP according to an embodiment of the present invention.
Figure 3:
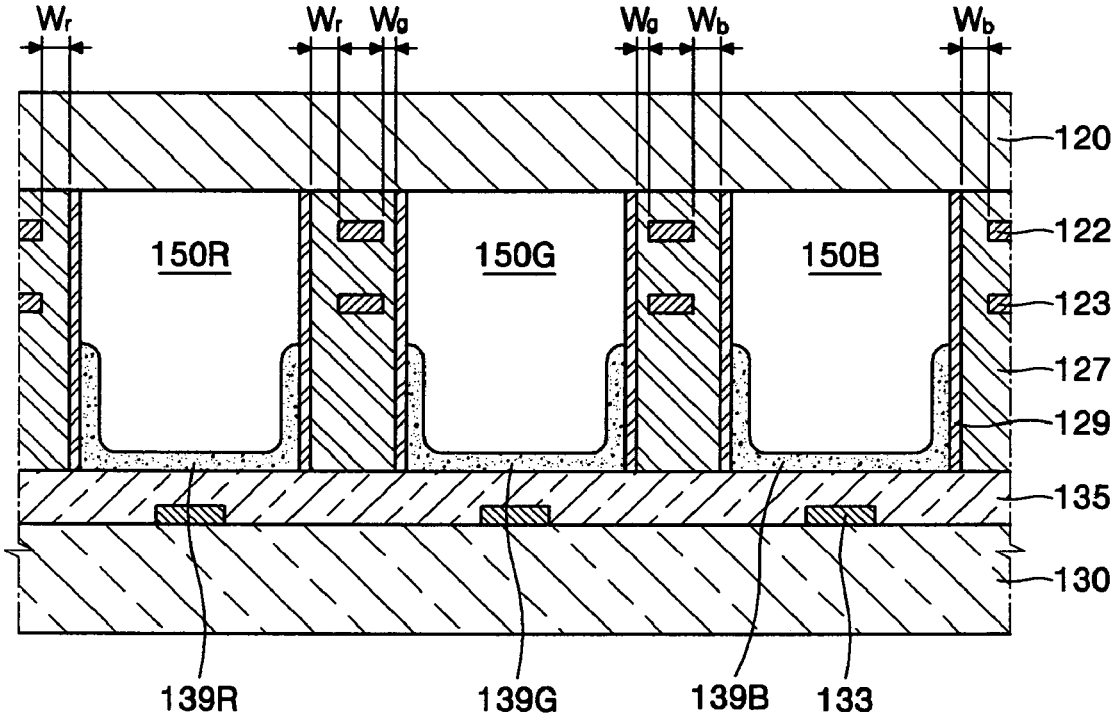
FIG. 3 is a sectional view taken along line III—III of FIG. 2.
Figure 4:
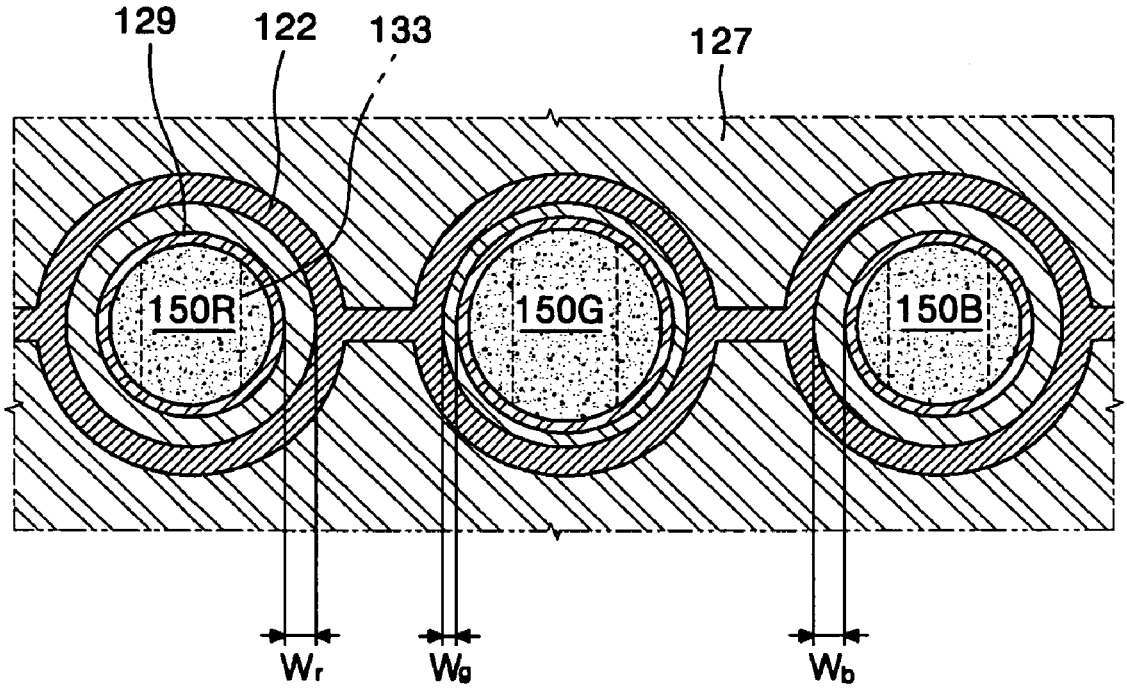
FIG. 4 is a sectional view taken along line IV—IV of FIG. 3.
Figure 5:
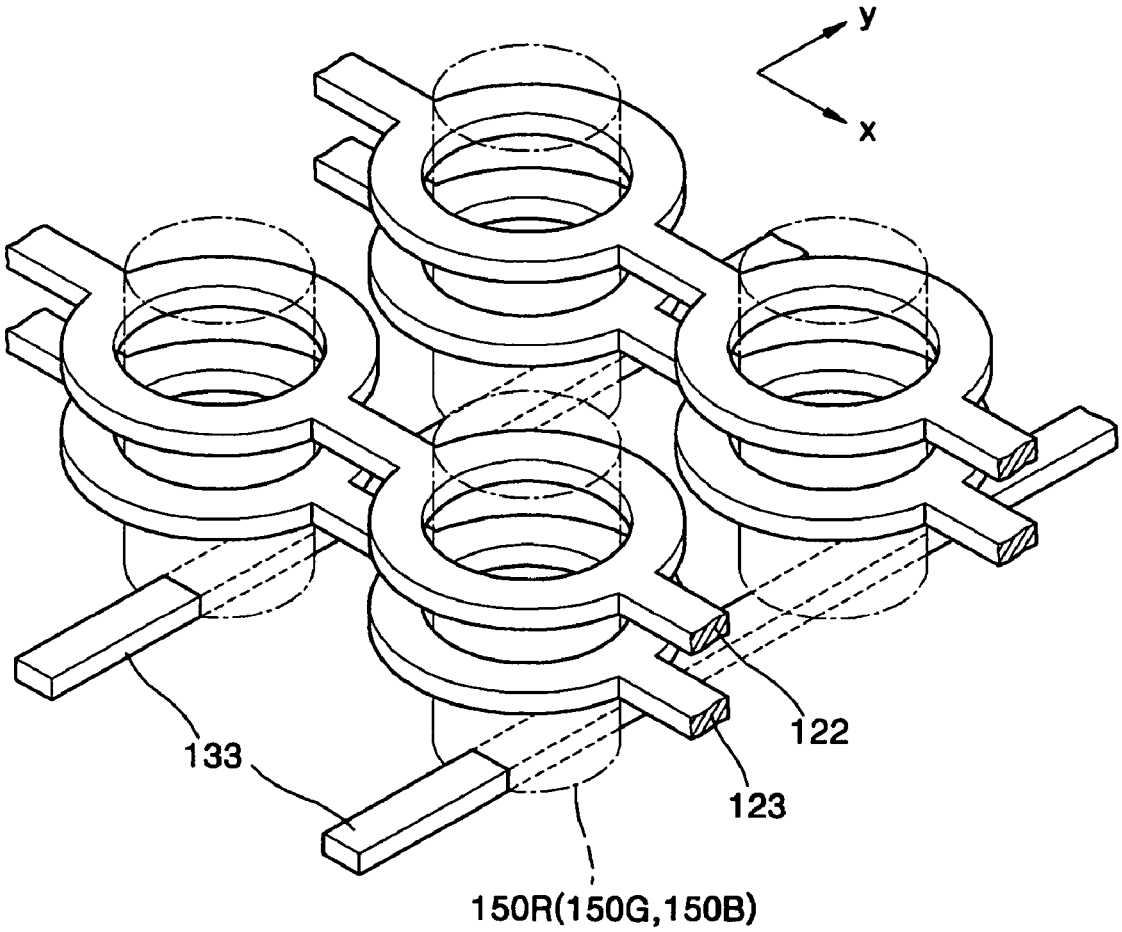
FIG. 5 is a perspective view illustrating an arrangement of a front discharge electrode, a rear discharge electrode, and an address electrode.
Figure 6:
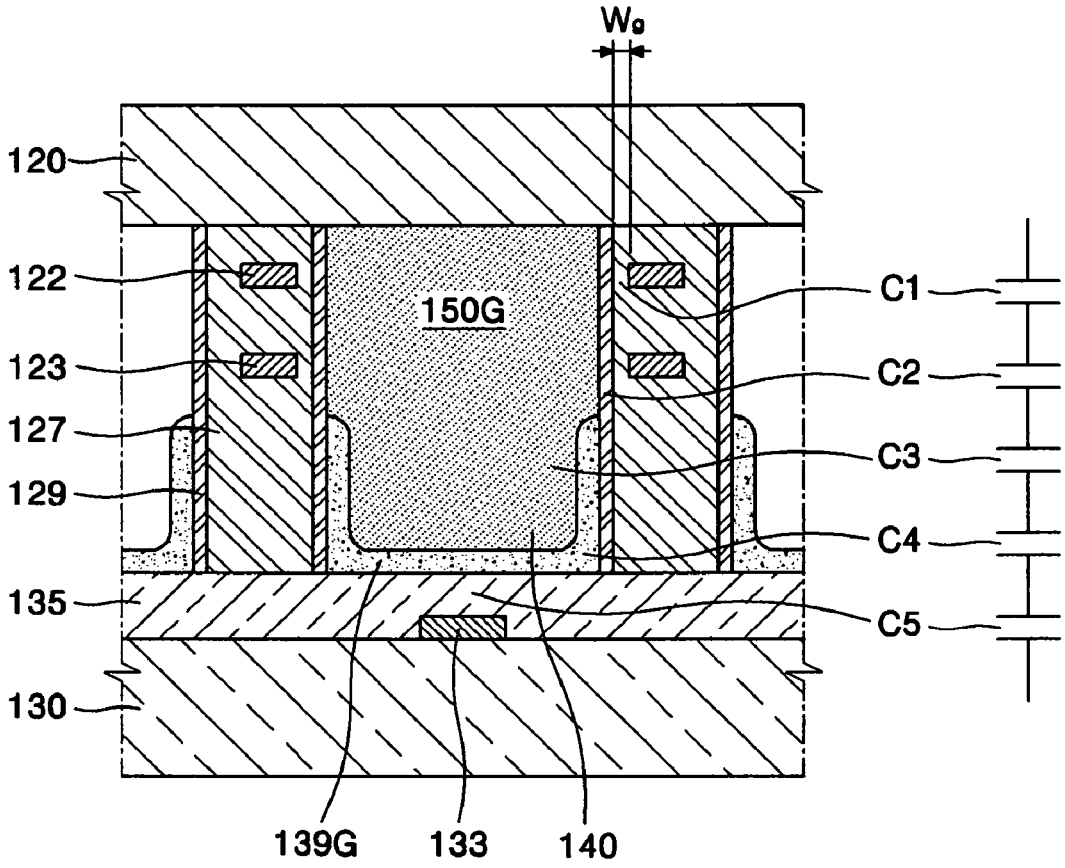
FIG. 6 is a sectional view illustrating a circuit equivalent to constituent elements of a green discharge cell.

FIG. 2 is an exploded perspective view of a PDP according to an embodiment of the present invention, while FIG. 3 is a sectional view taken along line III—III of FIG. 2, FIG. 4 is a sectional view taken along line IV—IV of FIG. 3, FIG. 5 is a perspective view illustrating an arrangement of a front discharge electrode, a rear discharge electrode, and an address electrode, and FIG. 6 is a sectional view illustrating a circuit equivalent to constituent elements of a green discharge cell.

Referring to FIGS. 2 thru 4, a plasma display panel (PDP) 100 according to an embodiment of the present invention includes a front panel 120, a rear panel 130, side dielectric layers 127, front discharge electrodes 122, rear discharge electrodes 123, phosphor layers 139R, 139G and 139B, address electrodes 133, and discharge gas 140 (see FIG. 6).

The front panel 120, through which visible rays of light can pass so as to project an image, is disposed at a front side (z-direction) parallel to the rear panel 130.

The side dielectric layers 127 are formed between the front panel 120 and the rear panel 130. The side dielectric layers 127 are disposed at non-discharge portions and define discharge cells 150R, 150G, and 150B. The front electrodes 122 and the rear electrodes 123 are spaced apart from each other in the side dielectric layers 127. In this regard, the side dielectric layers 127 are disposed in a single body between neighboring discharge cells to serve as barrier ribs as illustrated in FIG. 2. To the contrary, barrier ribs are formed between the side dielectric layers 127 formed between the neighboring discharge cells, and define the discharge cells 150R, 150G and 150B to form a basic unit of an image, and to prevent crosstalk between discharge cells.

The phosphor layers 139R, 139G, and 139B are disposed at spaces defined by the side dielectric layers 127, the front panel 120, and the rear panel 130. The phosphor layers are composed of the red phosphor layers 139R emitting red visible rays, the green phosphor layers 139G emitting green visible rays, and the blue phosphor layers 139B emitting blue visible rays.

The discharge gas 140 (see FIG. 6) fills the discharge cells 150R, 150G, and 150B.

The front panel 120 is formed of a material, such as glass, which has an excellent optical transmittance, and through which visible rays of light are emitted to the outside.

The side dielectric layers 127 are formed of a dielectric substance and define adjacent discharge cells 150R, 150G, and 150B. The side dielectric layers 127 prevent the rear discharge electrodes 123 and the front discharge electrodes 122 from being electrically connected to each other during sustain discharge, and prevent the front discharge electrodes and the rear discharge electrodes 122 and 123 from being damaged due to the direct collision of charged particles. Further, the side dielectric layers 127 function to store wall charge by inducing the charged particles.

In this regard, as illustrated in FIG. 2, a cross section of the side dielectric layers 127 has a circular shape, so that the first and second electrodes 122 and 123 have a circular shape. In this case, corners of the side dielectric layers 127 are not supported, which does not cause an edge. Therefore, a sustain discharge is not partly performed, thereby increasing the lifetime of the PDP and causing no permanent afterimage. However, the present invention is not necessarily restricted thereto, and the side dielectric layers 127 and the first and second electrodes 122 and 123 may have a polygon shape such as that of a tetragon, an octagon, etc., or any other shape.

The front discharge electrodes 122 and the rear discharge electrode 123 are disposed inside the side dielectric layers 127. The front discharge electrodes 122 and the rear discharge electrode 123 may be formed of a conductive metal, such as aluminum, copper or silver.

At least one, corresponding to one discharge cell, of the front discharge electrodes 122 and the rear discharge electrodes 123 partly surrounds the discharge cells 150R, 150G and 150B. Conversely, at least one, corresponding to one discharge cell, of the front discharge electrodes 122 and the rear discharge electrodes 123 entirely surrounds the discharge cells 150.

The front discharge electrodes 122 and the rear discharge electrodes 123 may be disposed in directions which intersect each other. Specifically, the front discharge electrode 122 may extend along discharge cells 150R, 150G, and 150B, which are oriented in a first direction, and the rear discharge electrode 123 may extend along discharge cells 150R, 150G, and 150B, which are oriented in a second direction which intersects the first direction. In this case, either the front discharge electrode 122 or the rear discharge electrode 123 can serve as both an address electrode generating an address discharge and a sustain electrode generating a sustain discharge. To the contrary, one of the first electrode 122 and the second electrode 123 serves as an address electrode, and the other is divided into two electrodes to serve as an X electrode and a Y electrode.

Conversely, as shown in FIGS. 2 and 5, the front discharge electrodes 122 and the rear discharge electrode 123 may extend in one direction (an x-direction) parallel to each other and the address electrodes 133 may extend in another direction (a y-direction) intersecting the front discharge electrodes 122 and the rear discharge electrodes 123. The front discharge electrodes 122 and the rear discharge electrodes 123 intersect the address electrodes, which means that a line of the discharge cells 150R, 150G, and 150B, through which the address electrodes passes, and a line of the discharge cells 150R, 150G, and 150B, through which the front discharge electrodes and the rear discharge electrodes pass, intersect each other. Furthermore, the front discharge electrodes 122 extend in a direction parallel to that of the rear discharge electrodes 123, which means that the front discharge electrodes 122 and the rear discharge electrodes 123 are spaced from each other by a predetermined constant distance.

In this case, the rear discharge electrodes 123 and the front discharge electrodes 122 are electrodes for a sustain discharge (ks), and the sustain discharge for realizing an image of the plasma display panel occurs between the sustain discharge electrodes.

The address electrodes 133 are electrodes generating address discharge (ka) for facilitating the sustain discharge between the rear discharge electrodes 123 and the front discharge electrodes 122. More specifically, the address electrodes 133 have a function of lowering a starting voltage of the sustain discharge.

In this case, it is preferable that the address electrodes 133 be disposed between the rear panels 130 and the phosphor layers 139R, 139G, and 139B, and a dielectric layer 135 be formed between the address electrodes 133 and the phosphor layers 139R, 139G, and 139B. In this case, the rear panel 130 supports the address electrodes 133 and the dielectric layer 135.

Assuming that the rear discharge electrodes 123 serve as Y electrodes and the front discharge electrodes 122 serve as X electrodes, the address discharge (ka) occurs between the rear discharge electrode 123 and the address electrode 133. When the address discharge is terminated, positive ions are accumulated at the side of the rear discharge electrodes 123, and electrons are accumulated at the side of the front discharge electrodes 122. As a result, the sustain discharge easily occurs between the rear discharge electrodes 123 and the front discharge electrodes 122.

In FIG. 2, each the rear discharge electrodes 123 and the front discharge electrodes 122 is formed as a single electrode. However, each of the rear discharge electrodes 123 and the front discharge electrodes 122 may include two or more sub-electrodes.

As described above, the address electrodes 133 may be covered by the dielectric layer 135. The dielectric layer 135 is made of a dielectric substance, such as PbO, B2O3, SiO2, etc., which can prevent the address electrodes 133 from being damaged due to the collision of positive ions or electrons therewith, and can induce electric charges during discharge.

The side dielectric layers 127 are, preferably, covered by a protective layer 129. The protective layer 129 is not an essential component, but it functions to prevent the side dielectric layers 127 from being damaged due to the collision of the charged particles therewith, and to emit a lot of secondary electrons during discharge, so that it is preferable to form the protective layer 129.

The phosphor layers 139R, 139G, and 139B are disposed in the discharge cells. Specifically, when the plasma display panel 100 includes the partition walls 137, the phosphor layers 139R, 139G, and 139B are formed in spaces defined by the partition walls 137. In this case, it is preferable that the phosphor layers 139R, 139G, and 139B be disposed at the same level as the partition walls 137. Specifically, it is preferable that the side dielectric layers be made of a dielectric substance so as to cause the sustain discharge to easily occur and to exhibit an excellent memory characteristic. It is also preferable that the phosphor layers 139R, 139G, and 139B be formed on the partition walls 137 disposed below the side dielectric layers 127 so as to generate the visible rays in a wide area.

In this case, it is possible that the front discharge electrodes 122 and the rear discharge electrodes 123 be disposed to surround the upper side of the discharge cells 150R, 150G, and 150B. In the latter regard, the upper side of the discharge cells means a portion which is located above the phosphor layer 139R, 139G, and 139B. Conversely, the first and second electrode 122 and 123 surround bottom surfaces of the discharge cells 150R, 150G, and 150B in which the phosphor layers 139R, 139G, and 139B are disposed on the front panel 120.

Figure 7A:
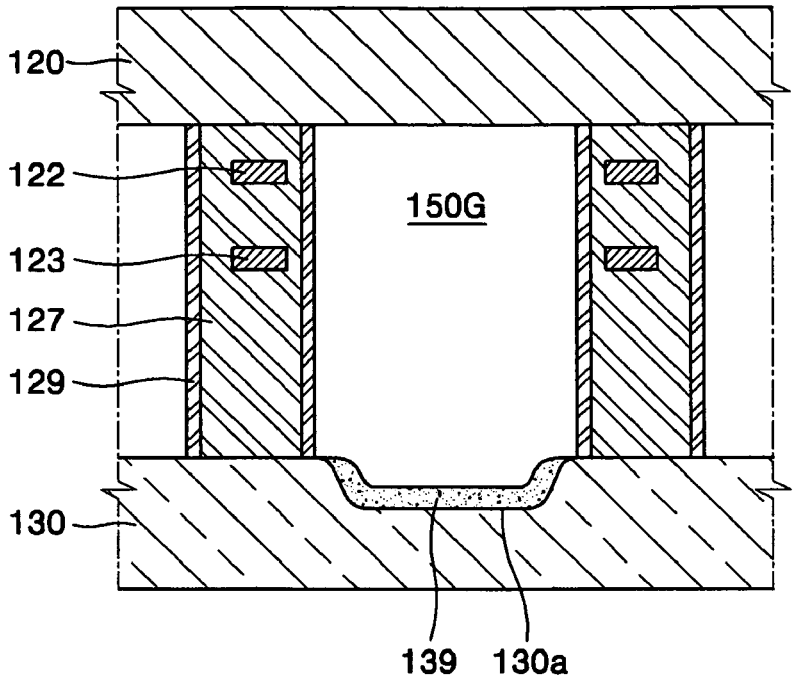
FIG. 7A is a cross-sectional view of a modification of the circuit illustrated in FIG. 6.

Referring to FIG. 7A, a groove 130*a* is formed in the rear panel 130 of every discharge cell, and the phosphor layers 139R, 139G, and 139B are formed in the groove 130*a*. In this case, address electrodes are preferably not disposed on the rear panel 130, such that the shape of the rear panel 130 has no restriction. If the groove 130*a* is formed in the rear panel 130, the surface cross-sectional area of the rear panel 130 is increased by the groove 13*a*. If the phosphor layer 139 is coated on the rear panel 130 having the groove 130*a*, the surface cross-sectional area of the phosphor layer 139 is increased.

Figure 7B:
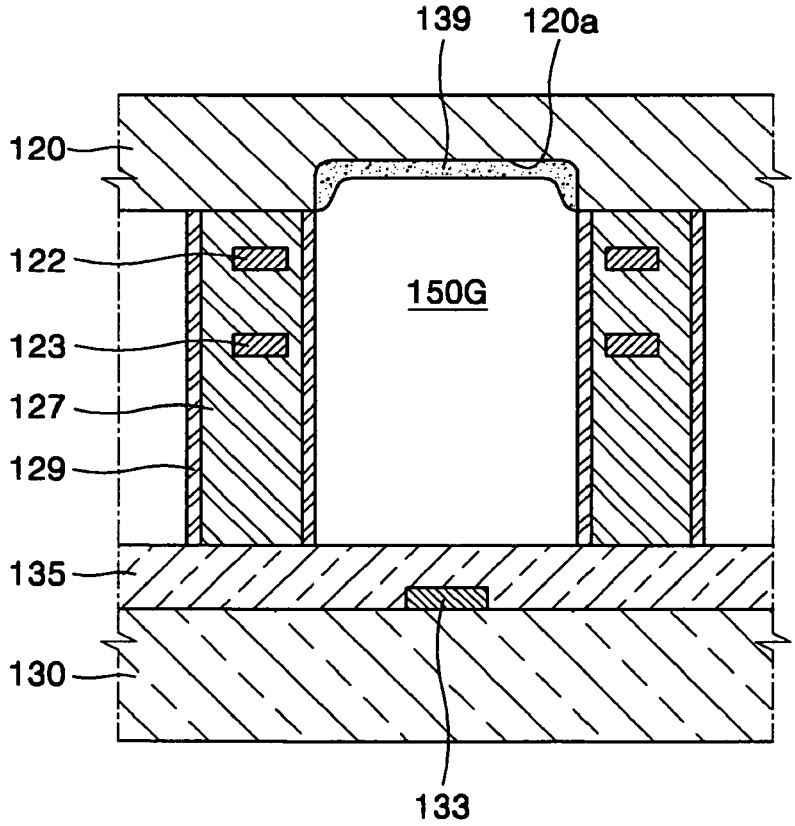
FIG. 7B is a cross-sectional view of another modification of the circuit illustrated in FIG. 6.

Referring to FIG. 7B, a groove 120*a* is formed in the front panel 120 of every discharge cell, and the phosphor layers 139R, 139G, and 139B are formed in the groove 120*a*. In this case, the PDP is a transmission type PDP. Since it is not necessary to form electrodes in the front panel 120, the groove 120*a* can be formed in the front panel 120. If the phosphor layer 139 is coated on the front panel 120 having the groove 120*a*, the surface cross-sectional area of the phosphor layer 139 is increased.

The phosphor layers 139R, 139G, and 139B include a component which receives ultraviolet rays emitted by the sustain discharge and which emits visible rays. The phosphor layers 139R disposed in sub-pixels emitting red light beams include a phosphor substance, such as $Y(V, P)O_4$:Eu, etc. The phosphor layers 139G disposed in sub-pixels emitting green light beams include a phosphor substance, such as $Zn_2SiO_4$:Mn, $YBO_3$:Tb, etc. The phosphor layers 139B disposed in sub-pixels emitting blue light beams include a phosphor substance, such as BAM:Eu, etc.

The discharge gas 140 filling the discharge cells 150R, 150G, and 150B is composed of a penning mixture, such as Xe—Ne, Xe—He, and Xe—Ne—He. The reason that Xe is used as the main discharge gas is described below. Since Xe is an inert gas, which is chemically stable, Xe is not dissociated by the discharge. Further, since the atomic number thereof is large, the excitation voltage is low and the wavelength of emitted light is large. The reason why He or Ne is used a buffer gas is that a voltage-decreasing effect caused by a penning effect due to Xe, and a sputtering effect caused by a high pressure, can be reduced.

The front panel 120 employed by the present invention is not provided with the transparent Y electrodes 23*a*, the transparent X electrodes 22*a*, the bus X electrodes 22*b*, the bus Y electrodes 23*b*, the front dielectric layer 25, and the protective layer 29, as shown in FIG. 1. As a result, the transmittance of the visible rays toward the front side largely increases to about 90%. Assuming that an image is realized with a conventional brightness level, the electrodes 122 and 123 can be driven with a relatively low voltage, whereby the light emission efficiency increases.

In this case, since the front discharge electrodes 122 and the rear discharge electrodes 123 are disposed at the side of the discharge spaces, and not on the front panel 120 transmitting visible rays, there is no need to use a transparent electrode with high resistance as the discharge electrode. Therefore, an electrode with low resistance (for example, a metal electrode) can be used as the discharge electrode. As a result, the discharge-response speed becomes fast, and it is possible to perform low-voltage driving without distorting the waveform.

On the other hand, assuming that 'A' is the surface area of a pole plate of a condenser, 'd' is the interval between the pole plates, and 'e' is the electric capacitance of an insulator interposed between the pole plates, 'C' is proportional to the dielectric constant e and the surface area 'A', and is inversely proportional to the interval 'd', that is, $C=\epsilon A/d$. In this case, when the sizes of the address electrodes 133, the rear discharge electrodes 123, and the front discharge electrodes 122 are equal to each other in the entirety of the discharge cells, the surface areas A of the pole plates are equal to each other in discharge cells 150R, 150G, and 150B. Furthermore, the distance from the address electrode 133 to the rear discharge electrode 123, or to the front discharge electrode 122, is also constant in each discharge cell. Therefore, the distances d between the pole plates are also the same in each discharge cell. The formed discharge cells have phosphor layers having a low dielectric constant e and a lower electric capacitance C than discharge cells in which the phosphor layers have a relatively high dielectric constant ?.

In addition, assuming that 'Q' is an amount of electric charge and 'V' is a voltage, the electric capacitance C is proportional to the amount of electric charge, that is, $C=Q/V$. Therefore, there is need to increase voltage to equalize the amount of electric charge, Q, of discharge cells in which the phosphor layers have a relatively low electric capacitance C to the amount of electric charge, Q, of the other discharge cells. In this case, the degree of voltage drop is not negligible in discharge cells in which the phosphor layers having a relatively low dielectric constant e are formed. Therefore, to compensate for the voltage drop, the voltage needs to be increased in the discharge cells in which the phosphor layers having a relatively low dielectric constant e are formed.

From this standpoint, if the distance d between the pole plates and the surface area A of the pole plates is the same in all discharge cells 150R, 150G, and 150B, there is a need to control the discharge starting voltage in conformity with the discharge cells having a relatively high discharge starting voltage. As a result, the efficiency of the driving voltage decreases, thereby deteriorating driving performance of the plasma display panel.

According to the present invention, as shown in FIG. 3, to overcome such a problem, the electrode-burying depths are differently formed in correspondence to red, green, and blue discharging cells in which the phosphor layers 139R, 139G, and 139B are disposed, each of which emits visible rays of red, green, and blue.

In this case, the electrode-burying depth corresponding to discharge cells differs according to a dielectric constant size of phosphor layers corresponding to the discharge cells. The electrode-burying depth corresponding to the discharge cells in which the phosphor layers having the lowest dielectric constant e are disposed is smaller than the electrode-burying depth corresponding to the discharge cells in which the phosphor layers having a relatively high dielectric constant e are disposed. Here, the electrode-burying depths (Wr, Wg, Wb) mean the depths or distances from the side surfaces of the first partition wall of each discharge cell to the front discharge electrode 122 or the rear discharge electrode 123 which is disposed inside the side dielectric layer and which corresponds to the discharge cell.

In this case, the phosphor layers having the lowest dielectric constant e are the green phosphor layers emitting visible rays of green. It is preferable that the electrode-burying depth (Wg) corresponding to the green discharging cells 150G, in which the phosphor layers 139G are formed, be smaller than electrode-burying depths Wr and Wb corresponding to the red and blue discharge cells 150R and 150B, in which the red phosphor layers and blue phosphor layers 139G and 139B are formed.

More specifically, a fluorescent substance, which is used in general phosphor layers 139R, 139G, and 139B employed in the plasma display panel, has a particle size of about 2 to 4 μm and a thickness of 15 to 20 μm.

The green phosphor layers 139G emitting visible rays of green are made of $Zn_2SiO_4$:Mn, $YBO_3$:Tb, and the charged amount of the green phosphor layers 139G is less than that of the red and blue phosphor layers 139R and 139B emitting visible rays of red and blue. Therefore, when the electrode-burying depths Wr, Wg, and Wb are equal in all discharge cells 150R, 150G, and 150B, the discharge starting voltage of the green discharge cells 150G increases. Specifically, assuming that the discharge starting voltages of the red and blue discharge cells 150R and 150B are about 165 to 183V, in discharge cells in which the phosphor layers having same thickness, the discharge starting voltage of the green discharge cells 150G is about 169 to 184V, which is relatively higher than that of the red and blue discharge cells 150R and 150B.

Therefore, the dielectric constants e of the phosphor layers 139R, 139B are equal to or similar to each other, but the dielectric constant e of the green phosphor layers 139G is relatively lower than that of the red and blue phosphor layer 139R and 139B.

Thus, it is preferable that the electrode-burying depth Wg corresponding to the green discharge cells 150G be smaller than that of the electrode-burying depths Wr and Wb corresponding to the red discharge cells 150R and the blue discharge cell 150B.

This will be apparent from an equivalent circuit of the green discharge cells 150B shown in FIG. 6, which is a sectional view illustrating a circuit equivalent to constituent elements of a green discharge cell.

Referring to FIG. 6, assuming that the side dielectric layers 127, the protective layer 129, the discharge gas 140, and the dielectric layer 135 are serially connected to each other, and capacitors have constant electric capacitance, it is possible to obtain the entire electric capacitance of the green discharge cells 150G using the equivalent circuit.

Specifically, assuming that C1 is the electric capacitance of the side dielectric layers, C2 is the electric capacitance of the protective layer, C3 is the electric capacitance of the discharge gas, C4 is the electric capacitance of the phosphor layer, and C5 is the electric capacitance of the dielectric layer, the total electric capacitance of the green discharge cell 150G can be expressed as follows: $1/C=1/C1+1/C2+1/C3+1/C4+1/C5$. Specifically, if the electric capacitance of the first partition wall in a discharge cell, the phosphor layer of which has a low dielectric constant, can be increased, the electric capacitance of the entire discharge cell can be increased.

In this case, the electric capacitance C1 of the side dielectric layers is inversely proportional to the electrode-burying depth, that is, $C=\epsilon A/d$. Therefore, when the electrode-burying depth Wg corresponding to the green discharge cell 150G decreases, the total electric capacitance C thereof increases.

Accordingly, when the electrode-burying depth Wg has an appropriately small thickness relative to the electrode-burying depth Wr of the red discharge cell and the electrode-burying depth Wb of the blue discharge cell, each the discharge cells 150R, 15G and 150B can have an equal or similar electric capacitance.

As a result, even though the same discharge starting voltage is applied to the respective discharge cells 150R, 150G, and 150B, uniform discharge can be generated and stable discharge can be maintained. In addition, since the discharge starting voltage can be lowered to the discharge starting voltage of the discharge cells in which the phosphor layers having the smallest dielectric constant are formed, the voltage margin is increased.

Hereinafter, the operation of the plasma display panel 100 having the above-described structure will be described. In this case, it is assumed that the rear discharge electrodes 123 serve as the Y electrodes, which generate the address discharge Ka in cooperation with the address electrodes 133, and the front discharge electrodes 122 serve as the X electrodes, which generate the sustain discharge in cooperation with the rear discharge electrode 123, as shown in FIG. 3.

First, the address voltage is applied between the address electrodes 133 and the rear discharge electrodes 123, and thus the address discharge occurs. Depending on the result of the address discharge, discharge cells 150R, 150G, and 150B, in which the sustain discharge will occur, are selected.

Then, when an alternative sustain discharge voltage is applied between the rear discharge electrodes 123 and the front discharge electrodes 122 of the selected discharge cells, the sustain discharge occurs between the discharge electrodes, and ultraviolet rays are emitted while the energy level of discharge gas is lowered, which is excited due to the sustain discharge. Furthermore, the ultraviolet rays excite the phosphor layers 139 coated inside the discharge cells, and thus visible rays are emitted while the energy level of the excited phosphor layers is lowered, whereby the emitted visible rays realize an image.

Figure 8:
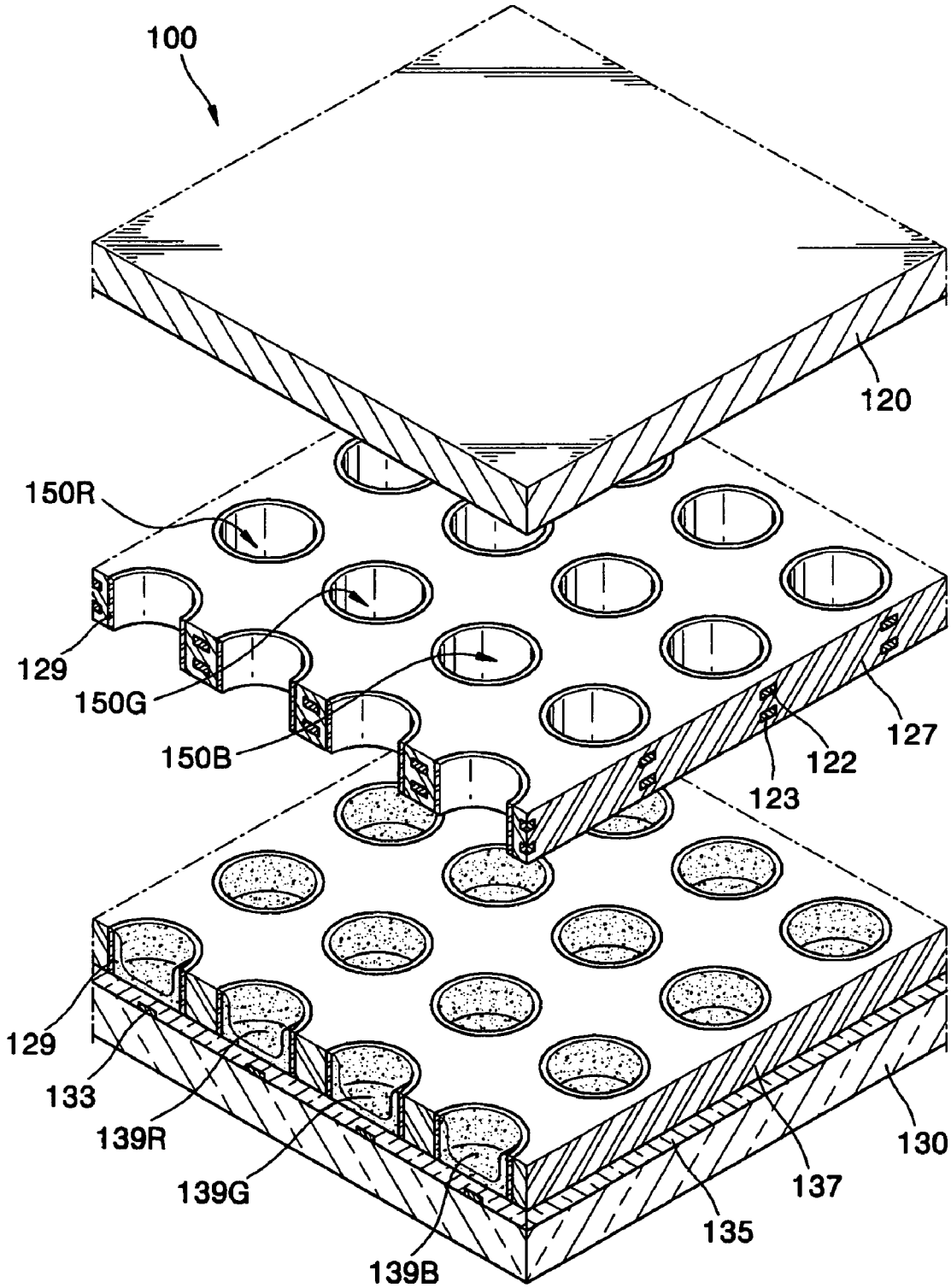
FIG. 8 is an exploded perspective view of a PDP according to another embodiment of the present invention.

Meanwhile, referring to FIG. 8, partition walls 137 may be formed between the side dielectric layers 127 and the rear panel 130. In this case, the partition walls 137 are disposed between the side dielectric layers 127 and the rear panel 130, and define the discharge cells 150R, 150G, and 150B in cooperation with the side dielectric layers 127. The partition walls 137 prevent the occurrence of undesirable discharge among the discharge cells 150R, 150G, and 150B. FIG. 8 shows that the partition walls 137 define the discharge cells 150R, 150G, and 150B in a circular shape, but the invention is not limited thereto, and the discharge cells 150R, 150G, and 150B may be defined in other shapes, such as a honeycomb shape. Furthermore, FIG. 8 shows that the discharge cells 150R, 150G, and 150B defined by the partition walls 137 have a circular cross-section, but the invention is not limited thereto, and the cross-section thereof may be formed in a polygonal shape, such as that of a triangle and a pentagon, or may be formed as a circle or an ellipse.

Conversely Partition walls 137 may be formed between the side dielectric layers 127 and the front panel 120.

The plasma display panel having the above-describe construction has the following advantages.

First, since no element is formed in the portion of the front panel through which the visible rays are transmitted, the aperture ratio can be largely increased, and the transmittance can be increased to about 90%.

Second, since the sizes of the discharge cells in the horizontal and vertical directions are similar to each other, the discharge area can be uniformly enlarged, the electric field can be concentrated on the center, and abnormal discharge does not occur. Therefore, the light emission efficiency increases. Furthermore, the discharge occurs from the side surfaces forming a discharge space and diffuses into the center of the discharge space, and thus plasma is also concentrated on the center of the discharge space. In addition, plasma tends to be concentrated at the center of the discharge space due to the electric field generated by the voltage applied to the discharge electrodes formed on the side surfaces. Therefore, it is possible to utilize the space charges for the discharge.

Third, the volume and the amount of plasma can be significantly increased. In the plasma display panel according to the present invention, the discharge occurs at the side surfaces forming the discharge space, and diffuses into the center portion, so that the volume of the plasma due to the discharge can be significantly increased, and the amount of the plasma can be significantly increased. Thus, it is possible to emit visible rays to large extent due to the increased amount of plasma.

Fourth, it is possible to significantly enhance the light emission efficiency. The present plasma display panel having the above-described effect can be driven at a low voltage. Thus, the light emission efficiency can be largely enhanced.

Fifth, even though a highly-concentrated Xe gas is used as the discharge gas, it is possible to enhance the light emission efficiency. When the highly-concentrated Xe gas is used as the discharge gas, it is generally difficult to operate the plasma display panel at a low voltage. However, in the plasma display panel according to the present invention, low-voltage driving becomes possible, as described above. As a result, even though a highly-concentrated Xe gas is used as the discharge gas, the low-voltage driving becomes possible, thereby enhancing the light emission efficiency.

Sixth, the discharge-response speed is fast and the low-voltage driving becomes possible. In the plasma display panel according to the present invention, discharge electrodes are disposed at the side of the discharge space, not on the portion of the front panel through which the visible rays can transmit, so that it is possible to use an electrode having low resistance, such as a metal electrode, as the discharge electrode, and not use a transparent electrode with high resistance. Thus, the response speed becomes fast and low-voltage driving becomes possible without distorting the waveform.

Seventh, it is possible to basically prevent a permanent after-image. In the plasma display panel according to the present invention, the plasma is concentrated at the center of the discharge space by the electric field which is generated by the voltage applied to the discharge electrodes disposed at the side of the discharge cells, thereby preventing ions generated by the discharge from colliding with the phosphor layers due to the electric field, even though the discharge is performed for a long period of time. Thus, it is possible to basically prevent the problem of a permanent after-image remaining due to damage to the phosphor layers caused by ion sputtering. Specifically, when a highly-concentrated Xe gas is used as the discharge gas, the permanent after-images cause a serious problem. However, according to the present invention, it is possible to basically prevent the permanent after-images.

Eighth, the electrode-burying depth is different in each discharge cell depending on the dielectric constants of the phosphor layers, so that the discharge drive voltages in the discharge cells are controlled so that they are equal or similar to each other, thereby securing a wide range of voltage margin. Thus, it is possible to secure a large voltage margin.

While the present invention has been particularly shown and described with reference to exemplary embodiments thereof, it will be understood by those of ordinary skill in the art that various changes in form and detail may be made therein without departing from the spirit and scope of the present invention as defined by the following claims.

What is claimed is:

1. A plasma display panel, comprising:

a front panel;

a rear panel disposed parallel to the front panel;

side dielectric layers formed of a dielectric material and disposed between the front panel and the rear panel so as to define a plurality of discharge cells;

front discharge electrodes disposed inside the side dielectric layers, and spaced apart from side surfaces of the discharge cells toward interiors of the side dielectric layers by an electrode-burying depth;

rear discharge electrodes disposed inside the side dielectric layers and on a rear side of the front discharge electrodes, and spaced apart from the side surfaces of the discharge cells toward the interiors of the side dielectric layers by the electrode-burying depth;

a plurality of phosphor layers corresponding to the discharge cells for emitting visible rays, said phosphor layers having different dielectric constants; and a discharge gas deposited in the discharge cells;

wherein an electrode-burying depth corresponding to the discharge cells differs according to a magnitude of a dielectric constant of the phosphor layers corresponding to the discharge cells.

2. The plasma display panel according to claim 1, wherein an electrode-burying depth corresponding to discharge cells in which phosphor layers having a lowest dielectric constant are disposed is smaller than an electrode-burying depth corresponding to discharge cells in which phosphor layers having a relatively high dielectric constant are disposed.

3. The plasma display panel according to claim 2, wherein each phosphor layer emits visible rays comprising any one of red, green and blue visible rays; and wherein an electrode-burying depth corresponding to discharge cells in which phosphor layers emitting the green visible rays are disposed is smaller than an electrode-burying depth corresponding to discharge cells in which phosphor layers emitting any one of the red and blue visible rays are disposed.

4. The plasma display panel according to claim 1, wherein the front discharge electrodes and the rear discharge electrodes fully surround the discharge cells.

5. The plasma display panel according to claim 1, wherein at least one of the front discharge electrodes and the rear discharge electrodes partly surrounds the discharge cells.

6. The plasma display panel according to claim 1, wherein the front discharge electrodes extend in a first direction, and the rear discharge electrodes extend in a second direction intersecting the first direction.

7. The plasma display panel according to claim 1, further comprising address electrodes which extend in a direction intersecting directions of the front discharge electrodes and the rear discharge electrodes; and wherein the front discharge electrodes and the rear discharge electrodes extend in a same direction.

8. The plasma display panel according to claim 7, wherein the address electrodes are disposed between the rear panel and the phosphor layers; and said plasma display panel further comprising a dielectric layer disposed between the phosphor layers and the address electrodes.

9. The plasma display panel according to claim 1, further comprising a protective layer covering at least side surfaces of the side dielectric layers.

10. The plasma display panel according to claim 1, further comprising partition walls disposed between the side dielectric layers and the rear panel, and defining the discharge cells in cooperation with the side dielectric layers; and wherein the phosphor layers are disposed at a same level as the partition walls.

11. A plasma display panel, comprising:

a front panel;

a rear panel disposed parallel to the front panel;

side dielectric layers formed of a dielectric material and disposed between the front panel and the rear panel so as to define a plurality of discharge cells;

front discharge electrodes disposed inside the side dielectric layers, and spaced apart from side surfaces of the discharge cells toward interiors of the side dielectric layers by an electrode-burying depth;

rear discharge electrodes disposed inside the side dielectric layers and on a rear side of the first discharge electrodes, and spaced apart from the side surfaces of the discharge cells toward the interiors of the side dielectric layers by the electrode-burying depth;

a plurality of address electrodes disposed on the rear panel and extending in a direction intersecting directions of the front discharge electrodes and the rear discharge electrodes;

a dielectric layer covering the address electrodes;

a plurality of phosphor layers corresponding to the discharge cells for emitting visible rays, said phosphor layers having different dielectric constants; and a discharge gas deposited in the discharge cells;

wherein an electrode-burying depth corresponding to the discharge cells differs according to a magnitude of a dielectric constant of the phosphor layers corresponding to the discharge cells.

12. The plasma display panel according to claim 11, wherein an electrode-burying depth corresponding to discharge cells in which phosphor layers having a lowest dielectric constant are disposed is smaller than an electrode-burying depth corresponding to discharge cells in which phosphor layers having a relatively high dielectric constant are disposed.

13. The plasma display panel according to claim 12, wherein the phosphor layers emit visible rays comprising any one of red, green, and blue visible rays;

wherein an electrode-burying depth corresponding to discharge cells in which phosphor layers emitting the green visible rays are disposed is smaller than an electrode-burying depth corresponding to discharge cells in which phosphor layers emitting any one of the red and blue visible rays are disposed.

14. The plasma display panel according to claim 11, further comprising a protective layer covering at least side surfaces of the side dielectric layers.

15. The plasma display panel according to claim 11, wherein the front discharge electrodes and the rear discharge electrodes fully surround the discharge cells;

wherein front discharge electrodes driving one sub-pixel are each connected to a first terminal; and wherein rear discharge electrodes driving said one sub-pixel are each connected to a second terminal.

16. The plasma display panel according to claim 11, wherein at least one of the front discharge electrodes and the rear discharge electrodes partly surrounds the discharge cells.

17. The plasma display panel according to claim 11, further comprising partition walls disposed between the side dielectric layers and the rear panel, and defining the discharge cells in cooperation with the side dielectric layers; and wherein the phosphor layers are disposed at a same level as the partition walls.

* * * * *